US007862397B1

(12) United States Patent
Ng et al.

(10) Patent No.: US 7,862,397 B1
(45) Date of Patent: Jan. 4, 2011

(54) MECHANICAL APPARATUS OPERATED BY A SLIGHT LATERAL FORCE

(75) Inventors: Wing Keung Wally Ng, Hong Kong (HK); Donna J. Goes, Riverside, RI (US); Fred D. Eddins, Mapleville, RI (US)

(73) Assignee: Hasbro, Inc., Pawtucket, RI (US)

( * ) Notice: Subject to any disclaimer, the term of this patent is extended or adjusted under 35 U.S.C. 154(b) by 478 days.

(21) Appl. No.: 12/116,827

(22) Filed: May 7, 2008

(51) Int. Cl.
*A63H 33/00* (2006.01)

(52) U.S. Cl. ..... 446/71; 446/486; 446/487; 446/489; 40/411

(58) Field of Classification Search ..... 446/486, 446/487, 489, 71, 491, 310, 308, 309, 311, 446/69; 40/411, 415; 472/51, 54, 55
See application file for complete search history.

(56) References Cited

U.S. PATENT DOCUMENTS

| | | | | | |
|---|---|---|---|---|---|
| 564,686 | A | * | 7/1896 | Gottschalk | 446/192 |
| 2,701,934 | A | * | 2/1955 | Auzin | 446/310 |
| 2,968,121 | A | * | 1/1961 | Pearson Jr. et al. | 446/177 |
| 3,442,045 | A | * | 5/1969 | Green | 446/297 |
| 3,479,561 | A | | 11/1969 | Janning | |
| 3,501,861 | A | * | 3/1970 | Goldfarb et al. | 446/177 |
| 3,581,434 | A | * | 6/1971 | Fels | 446/309 |
| 4,187,532 | A | | 2/1980 | Naffier | |
| 4,319,751 | A | * | 3/1982 | Kurushima et al. | 273/440.1 |
| 4,673,367 | A | * | 6/1987 | MacBain | 446/4 |
| 4,869,704 | A | * | 9/1989 | Fisher | 446/486 |
| 6,468,126 | B1 | * | 10/2002 | Herber | 446/310 |
| 6,796,872 | B2 | * | 9/2004 | Herber | 446/310 |
| 7,025,478 | B1 | | 4/2006 | Reinecke et al. | |
| 2003/0232568 | A1 | | 12/2003 | Engel et al. | |

* cited by examiner

*Primary Examiner*—Gene Kim
*Assistant Examiner*—Matthew B Stanczak
(74) *Attorney, Agent, or Firm*—Perry Hoffman

(57) ABSTRACT

A toy or game apparatus that includes a base in the shape of a cupcake, a simulated flame structure movable between an exposed-to-view position and a hidden-to-view position within a simulated candle structure, a support structure mounted to the base with a top edge in contact with a bottom edge of the flame structure to support the flame structure in the exposed position, a reset structure having a slanted top surface to enable the flame structure to move to the support structure and have the top edge of the support structure engage the bottom edge of the flame structure, the candle structure being depressible for moving the support structure relative to the reset structure, and a spring for raising the flame structure and the support structure so that the flame structure is again exposed, is disclosed and described.

20 Claims, 4 Drawing Sheets

MECHANICAL APPARATUS OPERATED BY A SLIGHT LATERAL FORCE

FIELD OF THE INVENTION

The present invention relates generally to a mechanical apparatus that is operated by a small or slight lateral force, and, more particularly, to an apparatus, such as a toy or game, for young children that changes status or condition by receiving blown air or by being struck by a thrown or expelled soft item that provides the lateral force to operate the mechanical apparatus, where the apparatus is comprised solely of mechanical elements or structures.

BACKGROUND OF THE INVENTION

Toys and games for young children are designed to have play value at a reasonable expensive. A particularly desirable objective is to create a core toy around which various accessories can be sequentially developed. Often these objectives are not met for various reasons. However, efforts are continuously being made in those directions. One such successful core toy product is a baby doll sold under a Hasbro, Inc., brand, BABY ALIVE™. These dolls are produced with different functionalities including, in one case, the ejection of localized elevated air pressure when squeezed. In the case of the squeezable BABY™ brand doll, the object would be to use the puff or gust of air to enhance play value.

Elevated air pressure activated items or toys have been designed in the past. By way of example, see U.S. Pat. No. 3,479,561 for a "Breath Operated Device" to Janning; U.S. Pat. No. 4,187,532 for an "Electronic Candle" to Haffler; and U.S. Pat. No. 7,025,478 for an "Illuminable Apparatus" to Reinecke et al. These patents all purport to disclose a device that includes a light source and an electrical or electronic circuit. Blown air from a user changes the circuit in some fashion and extinguishes the light source. U.S. Patent Application Publication No. 2003/0232568 by Engel et al., for an "Acrobatic Doll And Doll Accessories Capable Of Activation By Air," purports to disclose a carefully balanced toy figure that may be moved in a predetermine manner by a user blowing on the figure.

These disclosures are interesting, but they do not have the play value, the simplicity, the low cost, and the robustness desired.

SUMMARY OF THE INVENTION

In accordance with the present invention, an advantageous method and apparatus are provided in the form of toys and games that are especially designed to be playable by young children. Described embodiments include an air pressure operated mechanical toy or game apparatus. One such embodiment relates to a birthday cupcake and candle toy apparatus. A feature of the toy apparatus is that there is disclosed a clever operation that changes the status of a simulated candle flame simply by blowing air at the flame. The apparatus also has the advantages of being simple, inexpensive and structurally robust. Another feature is that the apparatus is formed solely of mechanical parts without any electronics or electrical components. The toy embodiment also has no need for a power source.

Briefly summarized, the invention relates to an air operated mechanical apparatus including a base, a symbolic structure, such a simulated flame, movable between an exposed-to-view position and a hidden-from-view position, a support structure mounted to the base and in contact with the symbolic structure to enable the symbolic structure to maintain the exposed and the hidden positions, a reset structure to enable the symbolic structure to move from the hidden position to the exposed position, a depressible structure for moving the support structure relative to the reset structure, and a biasing structure mounted to the base to move the support structure wherein the symbolic structure is moved to the exposed position from the hidden position, and wherein a slight lateral force causes the symbolic element to move from the exposed position to the hidden position.

The invention also relates to a method for exposing and hiding the symbolic structure, or any other movable structure, in a toy or game apparatus, the method comprising the steps of aligning the reset structure, the spring, the support structure, the movable structure, and the depressible structure in the base, supporting the movable structure with the support structure in an exposed position above the depressible structure, supporting the movable structure with the support structure in the hidden position within the depressible structure after an application of a lateral force causes the movable structure to fall from the exposed position to the hidden position because of gravity, and supporting the movable structure with the support structure in the exposed position after depressing the depressible structure against the spring wherein the reset structure enables the movable structure to move relative to the support structure before the spring biases the movable structure to the exposed position.

BRIEF DESCRIPTION OF THE DRAWINGS

For the purpose of facilitating an understanding of the invention, the accompanying drawings and description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
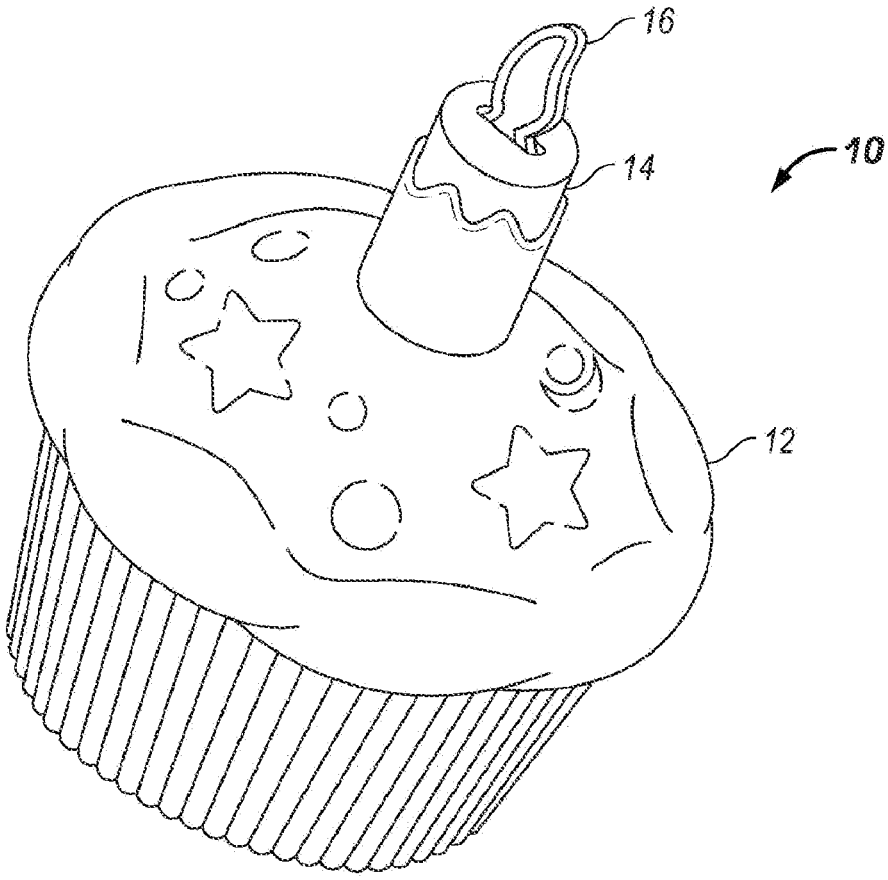
FIG. 1 is an isometric view of a preferred embodiment of a simulated birthday cupcake and candle toy apparatus with a simulated flame in an exposed-to-view position.
Figure 2:
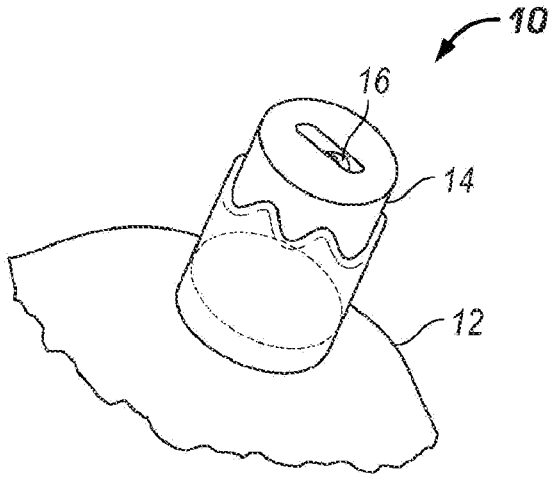
FIG. 2 is a partial isometric view of the simulated birthday cupcake and candle toy apparatus shown in FIG. 1, with the simulated flame in a hidden-from-view position.
Figure 3:
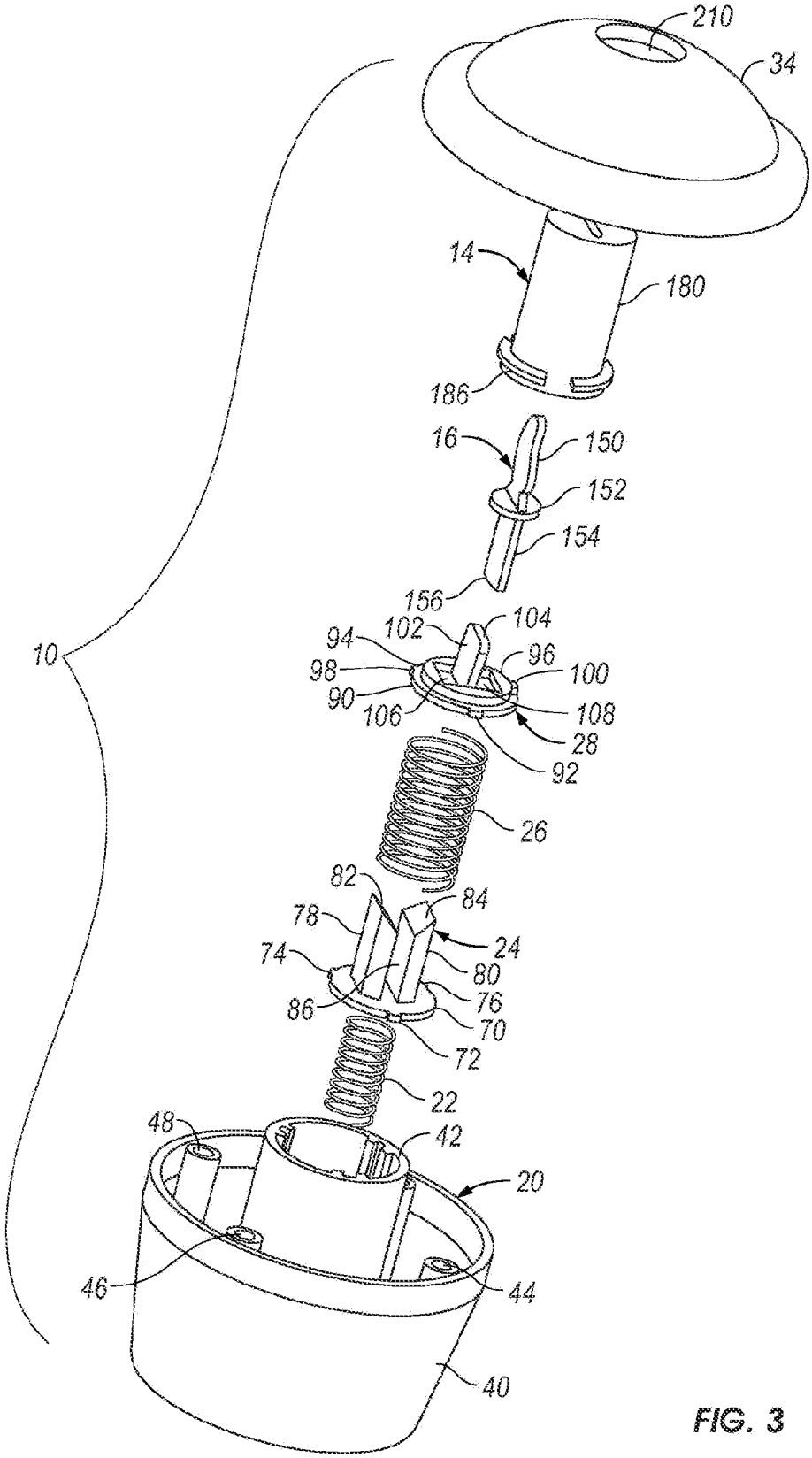
FIG. 3 is an exploded isometric view of a simulated birthday cupcake and candle toy apparatus variation, very similar to that shown in FIGS. 1 and 2.

Referring now to the Figures, FIGS. 1-3 show an embodiment of the invention in the form of an air operated toy apparatus 10 configured in the form of a cupcake 12 with a single candle structure 14 having an exposed simulated flame structure 16. By blowing on the candle, a higher air pressure is created, which pressure causes the exposed flame structure to fall under the influence of gravity into the candle structure as if blown out. The same result is achieved if the flame structure is gently touched or when the cupcake is gently shaken. In a boarder sense, the apparatus 10 may also be designated a lateral force operated mechanical apparatus, because in the alternative, the apparatus may take many other forms. The invention includes any apparatus where the condition, state, or status of a movable part of that apparatus is changed by a slight, generally lateral or horizontal force, whereby the movable part falls from a first position to a second position because of gravity.

For example, the apparatus may be embodied as a target set where a puff of compressed air, a spring launched ping-pong ball, or a projected soft dart, arrow or other element shot from a toy device may impact on an exposed-to-view structure or element to supply the lateral force necessary to cause the exposed structure to fall because of gravity and become hidden from view. Alternatively, the apparatus may be a sports game where a young child throws a bag or a soft ball at an exposed-to-view target, and when the target is hit, the target falls to an out-of-way, usually hidden position, to indicate a score.

As additional alternatives, the configuration of the apparatus may be modified by the formation of designs on the apparatus' surfaces, and/or the shape of the apparatus may be altered. For example, the apparatus configuration may assume the form of a slice of cake with a candle, or a square piece of cake with a candle. The apparatus may even be formed as a colonial candleholder/candle combination, or a plastic toy chandelier with several candles.

The cupcake and candle embodiment disclosed in detail herein, includes, when going from lower left to upper right in the drawing of FIG. 3, a cup shaped base 20, a lower spring 22, a reset structure 24, an upper spring 26, a support structure 28, the simulated movable flame structure 16, the candle structure 14, and a cover 34. More broadly, the lower and upper springs 22, 26 are biasing structures, and the simulated flame structure 16 may be considered a symbolic structure or element, or any movable structure, whose configuration depends upon the toy apparatus of which the symbolic structure is a part. For example, if the apparatus is a target set embodiment, the symbolic structure may be a bulls-eye target, or an animal or reptile depiction, or a picture or drawing of an enemy combatant.

It is noted that one or more of the identified structures may be removed, such as the lower spring and/or the cover, without disrupting in a major way the operation of the toy or degrading the toy's basic play value.

Figure 4:
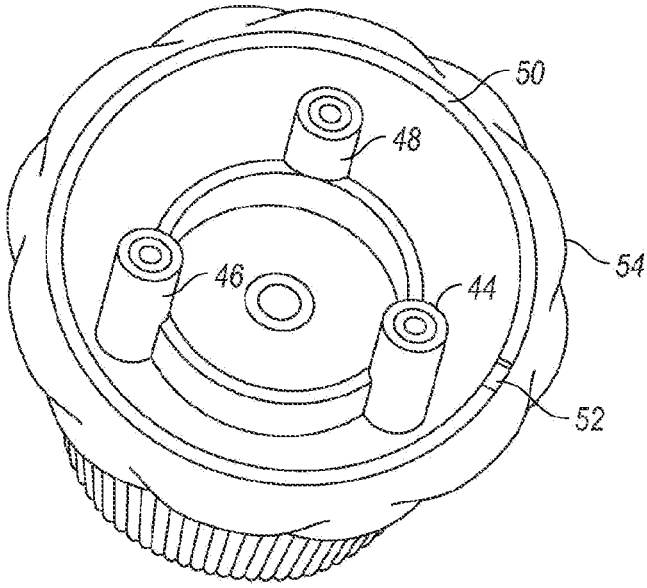
FIG. 4 is an isometric view of an interior of a base of the simulated cupcake and candle toy apparatus shown in FIGS. 1-3.
Figure 5:
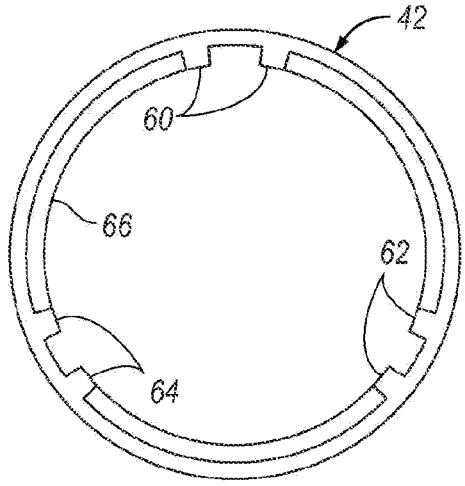
FIG. 5 is a top plan view of an inner sleeve of the simulated cupcake and candle toy apparatus shown in FIGS. 1-3.

The cup shaped base 20, FIGS. 3 and 4, includes a generally cylindrical outer wall 40, a cylindrical inner sleeve 42, and three screw-receiving posts 44, 46, 48. The outer wall 40 includes a top edge 50 with an indentation 52 and an undulating flange 54 (not shown in FIG. 3). The inner sleeve 42 includes three longitudinally extending guides, such as three pairs of guide rails 60, 62, 64, FIG. 5. An interior circumferential ledge 66 is formed at about the midsection of the inner sleeve 42. The three pairs of guide rails 60, 62, 64 includes one pair of guide rails 60 with a spacing between rails that is slightly larger or wider than the spacing between rails of the other two pairs of guide rails 62, 64. The different spacing ensures that other structures disposed to slide in the inner sleeve are keyed or located correctly for alignment purposes. Alternatively, the inner sleeve may be molded integrally with cup shaped base, or may be a detachable, separate part. Furthermore, the cup shaped base may be configured differently, with or without a scallop-like or ribbed outer surface, with or without an undulating flange, or having four screw-receiving posts, or just two posts or more than four posts, for example. In the alternative, the inner sleeve may include other guide configurations, such as grooves, and may have more or less than three such guides.

The lower spring 22, FIG. 3, is coiled and has a greater spring rate than the upper spring 26 that is also coiled. The reset structure 24 rests on the lower spring 22 and has a circular base 70 with three spaced radially extending tabs 72, 74, 76 and a spring seat (not shown) to engage and align the lower spring 22. The reset structure also includes two upstanding pedestals 78, 80 around which the upper spring 26 is disposed. The pedestals 78, 80 each have a slanted top surface 82, 84. The two top surfaces 82, 84 slant oppositely, but toward each other so that if the slanted surfaces were extended and touched one another, the lowest point of the angle formed would be between the two pedestals. A space 86, however, is formed between the two pedestals 78, 80, at the lowest point of the imaginary angle formed by the converging slanted surfaces 82, 84. The reset structure 24 may be formed as an integral item.

Figure 6:
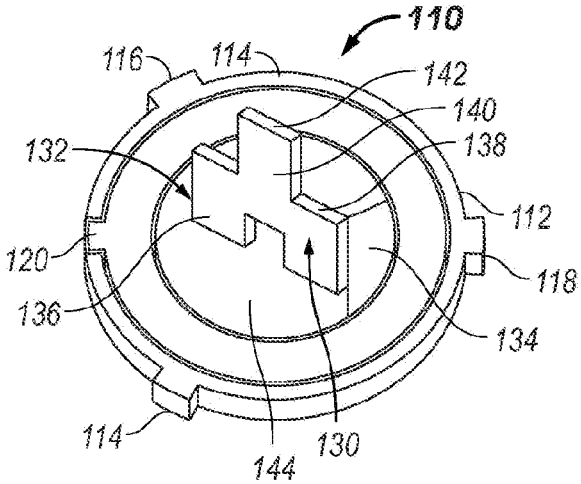
FIG. 6 is an isometric view of a support structure variation that may be used in the simulated cupcake and candle toy apparatus shown in FIGS. 1-3.

The support structure 28, FIG. 3, is seated on the upper spring 26 and includes a circular base 90 with three radially extending tabs 92, 94, 96. The support structure 28 also includes a circular ledge 98 with a slightly smaller diameter than the support structure circular base 90, and a radial tab 100 formed on the ledge 98. Extending upwardly from the circular base 90 is a small panel 102 with a top edge 104. To both sides of the panel 102 in the circular base 90 are openings 106, 108. Alternatively, as shown in FIG. 6, a modified support structure 110 may have a circular base 112 with three radially extending tabs 114, 116, 118, and a circular ledge 114 with another radial tab 120, all of which being similar to corresponding portions of the support structure 28. Instead of the small panel, however, the support structure 110 includes a bridge 130 having two opposing sidewalls 132, 134, and a cross wall 136 with a top edge 138. A thin tongue-like panel 140 with a top edge 142 extends upwardly from the bridge 130. Below the bridge, the circular base 112 of the support structure 110 has a large circular opening 144. The support structures 28, 110 may each be formed as an integral item.

Figure 7:
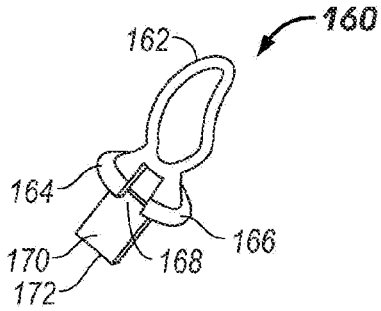
FIG. 7 is an isometric view of a simulated flame structure variation that may be used in the simulated cupcake and candle toy apparatus shown in FIGS. 1-3.

The flame or symbolic structure 16, FIG. 3, includes an upper simulated flame portion 150, a middle collar portion 152 and a lower stem portion 154 with a bottom edge 156. Alternatively, as shown in FIG. 7, a flame or symbolic structure 160 may include an upper flame portion 162, opposing flanges 164, 166, two opposing slots of which only one slot 168 is shown, there being one slot on each side of the flame structure beneath the upper portion 162, and a stem portion 170 with a bottom edge 172. The flame structures 30, 160 may each also be formed as an integral piece.

Figure 8:
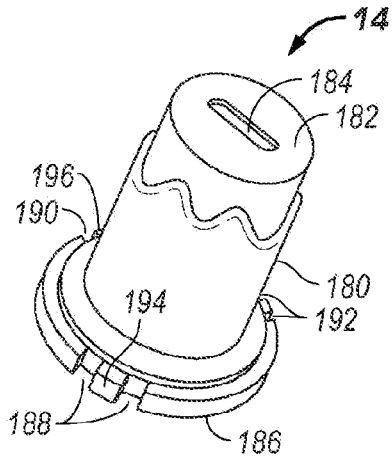
FIG. 8 is an isometric view of a candle structure of the simulated cupcake and candle toy apparatus shown in FIGS. 1-3.
Figure 9:
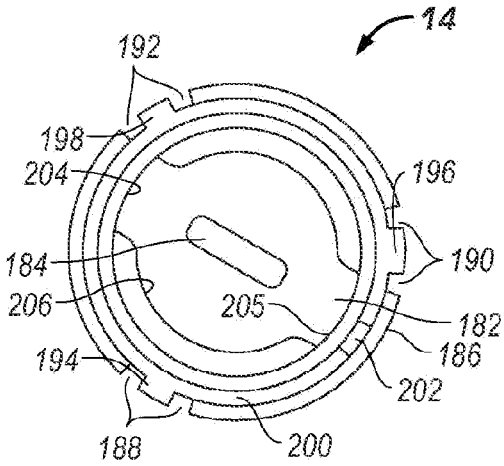
FIG. 9 is a bottom plan view of the candle structure shown in FIG. 8.

The candle structure 14, FIGS. 3, 8 and 9, has a cylindrical outer wall or body 180, a top wall 182 with a slot 184, a lower, horizontally extending flange 186 having three pairs of spaced indentations 188, 190, 192 so as to form three related radial tabs 194, 196, 198 and a vertically extending flange 200 with a single indentation 202. Keying indentations 204, 205 may be provided as part of the inner surface 206 of the outer wall 180 to mate with the flame structures 30, 160 to prevent rotation of the flame structures relative to the candle structure 14.

Figure 10:
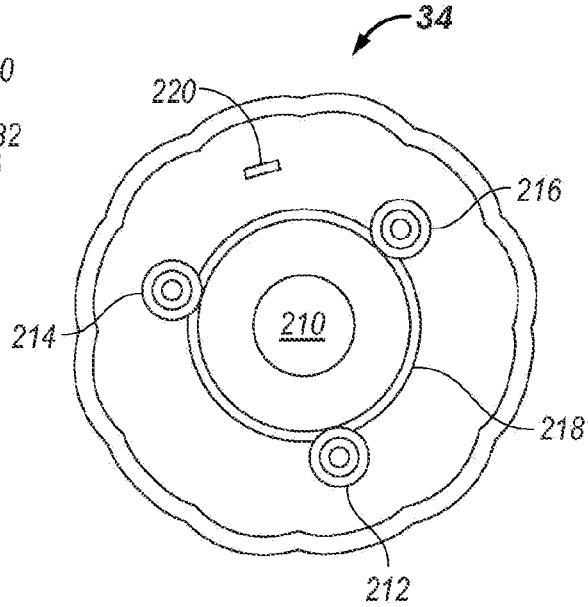
FIG. 10 is bottom plan view of a cover of the simulated cupcake and candle toy apparatus shown in FIGS. 1-3.

The cover or lid 34 is somewhat dome shaped, as shown in FIG. 3, with a central opening 210, FIG. 10, three screw-receiving posts 212, 214, 216, an internal collar wall 218 and a keying tab 220. As with the cup shaped base the cover may have four posts, or two posts or more than four posts.

The lower spring 22, the reset structure 24, the upper spring 26, the support structure 28, the flame structure 16, and the candle structure 14 are all linearly aligned in the cup shaped base 20, as shown in FIG. 3. These structures are prevented from rotation because the three tabs 72, 74, 76 of the reset structure 24, the three tabs 92, 94, 96 of the support structure 28, and the three tabs 194, 196, 198 of the candle structure 14 are restrained by the guides formed by the three pairs of guide rails 60, 62, 64 of the inner sleeve 42. As with the number of guides, the number of tabs of the structures may be more or less, but they will match the number of guides. Also, as with the guides, one tab from each of the structures will have a larger width than the remaining tabs to mate with the wider guide so as to facilitate correct alignment of the structures.

The candle structure 14 and the support structure 28 are also locked or keyed against relative rotation by the tab 100 of the support structure 28 being captured by the indentation 202 in the vertical flange 200 of the candle structure 14. Hence, the reset structure 24, the support structure 28 and the candle structure 14 are able to move in a linear manner upwardly and downwardly, but these structures cannot rotate relative to the inner sleeve 42. The linear and non-rotatable arrangement described above ensures that when either of the support structures 28, 110 is lowered, the small panel 102 or the tongue panel 140 of the respective support structure drops into the space 86 between the two pedestals 78, 80 of the reset structure 24. During this move the pedestals 78, 80 are received by the openings 106, 108, 144 in the support structures 28, 110.

The keying indentations 204, 205 of the candle keep the flame structures 16, 160 aligned within the candle body so that the simulated flame upper portions 150, 162 stay aligned with the slot 184 of the top wall 182 of the candle structure 14. The indentation 52 of the cup shaped base 20 mates with the tab 220 of the cover 34 and prevents relative rotation between the cup shaped base 20 and the cover 34.

The horizontal flange 186 of the candle structure 14 has a diameter sufficiently large to abut, when lowered, the interior ledge 66 of the sleeve 42 and limit the downward movement of the candle structure 14. The diameter of the circular base 90, 120 of the support structure 28, 110, however, is smaller and is able to pass the interior ledge 66 of the sleeve 42. The circular base 70 of the reset structure 24 has about the same diameter as the circular base 90, 120 of the support structure 28, 110 so as to also avoid being limited in movement by the interior ledge 66 of the sleeve 42. The vertical flange 200 of the candle structure 14 is configured to engage the top of the circular base 90, 120 of the support structure 28, 110. A bottom of the circular base 90, 120 of the support structure 28, 110 engages a top of the upper spring 26. A bottom of the upper spring 26 abuts the circular base 70 of the reset structure 24, such that the upper spring 26 is captured around the two pedestals 78, 80 of the reset structure 24. The circular base 70 of the reset structure 24 also engages a top of the lower spring 22. The lower spring 22 is supported and aligned by the cup shaped base 20.

The bottom edge 156, 172 (depending upon which embodiment is used) of the stem portion 154, 170 of the flame structure 16, 160 is configured to engage the top edge 104 of the small panel 102 or the top edge 142 of the tongue panel 140 (depending upon which embodiment is used) of the support structure 28, 110 when the flame structure 16, 160 is in a first or exposed position, but the top edge 104 of the small panel 102 or the top edge 142 of the tongue panel 140 engages the collar portion 152 or one or the other of the opposing flanges 164, 166 of the flame structure 16, 160 when the flame structure is in a second or hidden position. In the second position, the stem portion 154, 170 of the flame structure 16, 160 may extend through the openings 106, 108, 144 in the support structure 28, 110. The bottom edge 156, 172 of the stem portion 154, 170 of the flame structure 16, 160 is also configured to engage either of the two slanted surfaces 82, 84 of the pedestals 78, 80 and slide downwardly to the space 86 between the pedestals when that space is occupied by one of the support structures 28, 110. When the support structure 28, 110 is raised under the influence of the upper spring 26, the top edge 104 of the small panel 102 or the top edge 142 of the tongue panel 140 engages the bottom edge 156, 172 of the stem portion 154, 170 of the flame structure 16, 160 and causes the upper flame portion 150, 162 of the flame structure to return to the first or exposed position.

The collar wall 218 of the cover 32 aligns with the inner sleeve 42. Screw fasteners (not shown) may be used to attach the cover 34 to the cup shaped base 20.

In operation, when the flame structure 16, 160, as shown in FIG. 1, is in the first or exposed-to-view position, the lower and upper springs 22, 26 are fully extended, or nearly so, the depressible candle structure 14 is fully extended, and the top edge of the small panel 102 or of the tongue panel 140 engages, in a somewhat precarious manner, the bottom edge 156, 172 of the stem portion 154, 170 of the flame structure and supports the flame structure such that the upper simulated flame portion 150, 162 projects above the slot 184 in the top wall 182 of the candle structure 14. A puff of blown air (from a young child, for example) or any slight, generally laterally or horizontally directed force or pressure causes the bottom edge of the stem portion to slip off the top edge of the small panel or of the tongue panel and allows the flame structure to drop or fall under the influence of gravity to the second or hidden position within the candle structure, as shown in FIG. 2. The downward fall of the flame structure is limited by an abutment of the collar portion 152 or the opposing flanges 164, 166 of the flame structure and the top edge of the small panel or of the tongue panel of the support structure 28, 110.

To "relight" the toy candle by returning the flame structure to the first or exposed-to-view position, a user depresses the candle structure downwardly by pushing on the top wall 182 and against the biasing forces of the upper and lower springs 22, 26 to a position, as shown in phantom lines in FIG. 2, to cause the vertical flange 200 of the candle structure to push and depress the circular base 90, 112 of the support structure 28, 110. This causes a descent of the support structure and results in the small panel or the tongue panel of the support structure descending into the space 86 between the two pedestals 78, 80 of the reset structure 24. As the support structure descends, the bottom edge of the stem portion of the flame structure contacts one of the two slanted top surfaces 82, 84 of the pedestals (depending upon to which side of the small panel or of the tongue panel the flame structure slipped off) and slides down the slanted surface until the bottom edge of the stem portion is centered over the space between the pedestals. Depression of the candle structure is completed when the horizontal flange 186 of the candle structure abuts the interior ledge 66 of the sleeve 42. When the user releases the candle structure, thereby removing the depressing force from the top wall 182, the candle structure slides upwardly under the biasing influence of the upper and lower springs. The result is that the top edge 104, 142 of the small panel 102 or of the tongue panel 140 again engages the bottom edge 156, 172 of the stem portion 154, 170 of the flame structure and raises the flame structure such that the simulated flame portion 150, 162 again extends through and above the slot 184 in the top wall 182 of the candle structure as shown in FIG. 1.

It may now be appreciated that by aligning the lower spring 22, the reset structure 24, the upper spring 26, the support structure 28, and the depressible candle structure 14 with the flame structure 16, 160, the flame structure may be supported in either the exposed-to-view position or the hidden-to-view position. When in an exposed position, as shown in FIG. 1, the bottom edge 156, 172 of the flame structure 16, 160 is directly engaged by the top edge 104, 142 of the support structure 28, 110. After a gust of air or some other lateral force knocks the flame structure 16, 160 off the top edge 104, 142 of the support structure 28, 110, the flame structure falls because of gravity until the middle collar portion 152 or one of the opposing flanges 164, 166 of the flame structure abuts the top edge 104, 142 of the support structure. In both circumstances, the flame structure 16, 160 is supported by the support structure 28, 110.

When the candle structure is depressed, the support structure 28, 110 and the flame structure 16, 160 are lowered. The support structure enters the space 86 between the pedestals 78, 80, and the flame structure engages and slides along one of the slanted surfaces 82, 84 of the reset structure because of gravity. When the bottom edge 156, 172 of the flame structure reaches the space between the pedestals, the bottom edge of the flame structure is aligned with the top edge of the support structure. When the depressing force on the candle structure is released, the springs 22, 26 bias the candle structure, the support structure and thereby the flame structure upwardly so as to again expose the upper flame portion 150, 162 of the flame structure to view. Alignment of the reset structure, the support structure, and the candle structure is assured by the guide rails of the inner sleeve 42 and the mating tabs on the reset structure, the support structure and the candle structure.

The air operated toy apparatus just described in detail is simple, robust, easy to use, and inexpensive. The various structures of the apparatus may all be made of any suitable plastic, except for the lower and the upper springs, which typically are formed of metal, such as spring steel. Unlike the devices mentioned above in the earlier patents, the embodiments disclosed herein are formed of mechanical parts only and do not require or include any electronic or electrical elements, or any power source, such as an electrical battery.

The toy apparatus disclosed in detail above has great play value for young children. The toy apparatus allows a child to conceptualize a real birthday cake without any fire danger, and the apparatus may even arouse the mechanical interest of a child to figure out how the apparatus functions.

From the foregoing, it can be seen that there has been provided features for an improved toy or game apparatus and a method of exposing and hiding a movable structure. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. An air operated mechanical toy apparatus comprising:
a base;
a symbolic structure movable between an exposed position and a hidden position;
a support structure mounted to the base and in contact with the symbolic structure to enable the symbolic structure to maintain the exposed and the hidden positions;
a reset structure to enable the symbolic structure to move from the hidden position to the exposed position;
a depressible structure for moving the support structure relative to the reset structure; and
a biasing structure mounted to the base to move the support structure wherein the symbolic structure is moved to the exposed position from the hidden position and wherein a slight lateral force causes the symbolic element to move from the exposed position to the hidden position.

2. The apparatus of claim 1, including a second biasing structure mounted to the base for moving the reset structure.

3. The apparatus of claim 2, wherein the reset structure cooperates with the support structure for aligning the symbolic structure.

4. The apparatus of claim 2, wherein:
the support structure includes a top edge; and
the symbolic structure includes a bottom edge to enable contact with the top edge of the support structure.

5. The apparatus of claim 4, wherein the top edge of the support structure is in contact with the bottom edge of the symbolic structure when the symbolic structure is in the exposed position.

6. The apparatus of claim 5, wherein:
the support structure includes an opening; and
the symbolic structure extends into the opening of the support structure when the symbolic structure is in the hidden position.

7. The apparatus of claim 1, wherein the reset structure includes a slanted surface for directing the symbolic structure to the support structure.

8. The apparatus of claim 7, wherein the reset structure includes a space for receiving the support structure when the support structure is moved by the depressible structure.

9. The apparatus of claim 1, wherein the base includes a guide member.

10. The apparatus of claim 9, wherein the reset structure, the support structure and the depressible structure each includes a guide structure for engaging the guide of the base.

11. The apparatus of claim 1, including a cover mounted to the base, the cover having an opening through which the depressible structure moves.

12. The apparatus of claim 1, wherein:
the support structure includes a top edge;
the symbolic structure includes a bottom edge to enable contact with a top edge of the support structure;
the top edge of the support structure is in contact with the bottom edge of the symbolic structure when the symbolic structure is in the exposed position;

the reset structure includes a slanted surface for directing the symbolic structure to the support structure by the use of gravity;

the reset structure includes a space for receiving the support structure;

the base includes a guide; and the reset structure, the support structure and the depressible structure each includes a guide structure for engaging the guide of the base; and including a cover mounted to the base, the cover having an opening through which the depressible structure moves.

13. The apparatus of claim 1, wherein the reset structure cooperates with the support structure for aligning the symbolic structure.

14. The apparatus of claim 13, wherein:

the support structure includes a top edge;

the symbolic structure includes a bottom edge to enable contact with the top edge of the support structure; and the top edge of the support structure is in contact with the bottom edge of the symbolic structure when the symbolic structure is in the first position.

15. The apparatus of claim 14, wherein:

the reset structure includes a slanted surface for directing the symbolic structure to the support structure; and the reset structure includes a space for receiving the support structure.

16. The apparatus of claim 15, wherein:

the base includes a guide; and the reset structure, the support structure and the depressible structure each includes guide structure for engaging the guide of the base.

17. The apparatus of claim 16, including a cover mounted to the base, the cover having an opening through which the depressible structure moves.

18. A lateral force operated mechanical apparatus comprising:

a base;

a depressible structure mounted to the base;

a symbolic structure disposed within the depressible structure and movable between first and second positions;

a support structure mounted to the base to enable the symbolic structure to selectively maintain the first and the second positions;

a reset structure to enable the symbolic structure to move from the second position to the first position; and a biasing structure mounted to the base to move the support structure wherein the symbolic structure is moved to the first position from the second position, and wherein a slight lateral force causes the symbolic structure to move because of gravity from the first position to the second position.

19. A method for exposing and hiding a movable structure in a toy or game apparatus, the method comprising the steps of:

aligning a reset structure, a spring, a support structure, the movable structure and a depressible structure in a base;

supporting the movable structure with the support structure in an exposed position above the depressible structure;

supporting the movable structure with the support structure in a hidden position within the depressible structure after an application of a lateral force causes the movable structure to fall from the exposed position to the hidden position because of gravity; and supporting the movable structure with the support structure in the exposed position after depressing the depressible structure against the spring wherein the reset structure enables the movable structure to move relative to the support structure before the spring biases the movable structure to the exposed position.

20. The method of claim 19 including the steps of:

moving the movable element along a slanted surface of the reset structure;

positioning the support structure relative to the reset structure to cause the support structure to receive the moving movable element from the slanted surface of the reset structure; and supporting a bottom surface of the movable element on a top surface of the support structure as the spring moves the movable structure from the hidden position to the exposed position.

* * * * *